US006318954B1

(12) United States Patent
Voss et al.

(10) Patent No.: US 6,318,954 B1
(45) Date of Patent: Nov. 20, 2001

(54) DEVICE FOR STACKING SHEETS, IN PARTICULAR SHEET-FED PAPER OR CARDBOARD SHEETS DELIVERED ONTO PALLETS

(75) Inventors: Peter Voss, Jüchen; Ernst Claassen, Goch, both of (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/380,552

(22) PCT Filed: Mar. 7, 1998

(86) PCT No.: PCT/EP98/01342

§ 371 Date: Sep. 2, 1999

§ 102(e) Date: Sep. 2, 1999

(87) PCT Pub. No.: WO98/41465

PCT Pub. Date: Sep. 24, 1998

(30) Foreign Application Priority Data

Mar. 19, 1997 (DE) ..... 197 11 406

(51) Int. Cl.[7] ..... B65H 31/10

(52) U.S. Cl. ..... 414/794.4; 271/217; 414/926

(58) Field of Search ..... 414/796.7, 926, 414/794.4, 794.5, 794.6, 794.7, 794.8; 271/215, 217

(56) References Cited

U.S. PATENT DOCUMENTS 4,027,580 * 6/1977 Sundin ..... 414/926 X

FOREIGN PATENT DOCUMENTS 0 149 737 A1 7/1985 (EP) .
0 211 996 A1 3/1997 (EP) .

* cited by examiner

*Primary Examiner*—Janice L. Krizek
(74) *Attorney, Agent, or Firm*—Herbert Dubno

(57) ABSTRACT

Devices for stacking sheet-fed paper or cardboard sheets (1) on pallets (4) are known to have a vertically stationary conveyor (2) at a height above the maximum stack level above the floor and a storage platform (5) which can be raised and lowered upon which the stacks are formed. An optical sensor (17) which senses the stack level is arranged at the input side prior to the stacking area to control the lowering of the storage platform (5). According to the invention, at least three optical sensors (17) are disposed below the conveyor level at a slight distance from each other in a vertical line. The maximum vertical distance between the two sensors (17) is 20 mm. By activating any two sensors (17), the drop in height of the sheets (1) can be set depending on the type of sheet and without the need for extensive adjustment upon a change in the type of sheet.

3 Claims, 3 Drawing Sheets

DEVICE FOR STACKING SHEETS, IN PARTICULAR SHEET-FED PAPER OR CARDBOARD SHEETS DELIVERED ONTO PALLETS

CROSS REFERENCE TO RELATED APPLICATIONS

This application is a national stage of PCT/EP98/01342 filed Mar. 7, 1998 and based upon German national application 197 11 406.7 filed Mar. 19, 1997 under the International Convention.

TECHNICAL FIELD

The invention relates to a device for stacking sheets onto pallets, particularly paper or cardboard sheets fed in a scale-like (overlapping) manner.

BACKGROUND OF THE INVENTION

For the stacking of sheets downstream of a crosscutter it is known to use devices which have a raisable and lowerable storage platform, on which pallets for receiving the stacks have been laid. The sheets are conveyed to the stacking area and laid on the upper side of the stack by a vertically stationary feeder, arranged above the ground at a height which is greater than the maximal stack level. During stacking the storage platform is continuously lowered corresponding to the growth of the stack, so that the drop height of the sheets from the feeder to the upper side of the stack remains constant, insuring a trouble-free stacking with precisely aligned edges.

For a stack replacement the storage platform with the full pallet is lowered to the ground level. After the full pallet is removed and replaced with an empty pallet, the platform is raised to a level slightly below the feeding level. In order not to interrupt the feeding of sheets during a stack replacement, devices with an auxiliary stacking platform are known, which support the forming stack while the finished stack is removed. The empty pallets are then moved to a level directly below the auxiliary stacking platform and take over the partial stack formed on the auxiliary stacking platform.

STATE OF THE ART

From DE 38 23 806 C2 a stacking device is known, wherein the control of the lowering motion of the storage platform is performed by means of an optical sensor, which is arranged on the incoming side of the stacking area and detects the stack height.

The document EP-A-0 211 996 discloses a generic stacking device wherein laterally next to the storage platform three optical sensors are arranged vertically one above the other, which are all active during operation. The individual sensors are arranged at distances of 10–20 mm, 20–40 mm and 40 to 60 mm underneath the upper end of the feeding conveyor and serve for controlling the lowering speed of the storage platform.

From the EP-A-0 149 737 a stacking device is known, wherein at the beginning of the stacking area laterally five initiators are arranged vertically one above the other at a height at which the storage platform is supposed to be when a stack replacement is to take place. Each of the initiators can be separately activated and can trigger a braking device for stopping the supplied flow of sheets, in case the storage platform has reached this position due to the curvature of the sheets, although the preset number of sheets to be deposited has not been reached.

In practice it has been proven that the drop height of the sheets, which has to be kept substantially constant, has to be set differently, depending on the type of paper or cardboard. Therefore in case of a paper-type change, the optical sensor registering the desired stack level has to be reset in another vertical position in a complicated manner.

OBJECT OF THE INVENTION

It is the object of the invention to improve a generic stacking device, so that the drop height of the sheets can be set at various values without effort, in a simple manner.

SUMMARY OF THE INVENTION

According to the invention, at least three optical sensors for the upper stack side are arranged vertically one above the other and are separately actuatable. Each time two selected sensors establish the maximal drop height deviation and in this way make possible a control of the storage platform in such a manner that an upper maximal value cannot be exceeded and so that it can not fall below a lower minimal value.

In accordance with the invention, a device for stacking sheets onto pallets, particularly paper or cardboard sheets fed in an overlapping manner comprises a vertically stationary feeding conveyor for the sheets arranged above the floor at a height exceeding the maximum stacking level, a raisable and lowerable storage platform on which the stacks are formed, and at least three optical sensors arranged vertically one above the other at a slight distance below the feeding level. The optical sensors can be separately activated and are arranged on the incoming side upstream of the stacking area, whereby the vertical distance between two sensors amounts to a maximum 20 mm. More particularly, the vertical distance between two sensors can range between 5 mm and 10 mm. The sensors can be reflecting optical sensors.

BRIEF DESCRIPTION OF THE DRAWING

The drawing serves for the clarification of the invention with the aid of an embodiment example shown in a simplified manner.

WAYS FOR IMPLEMENTING THE INVENTION

Figure 1:
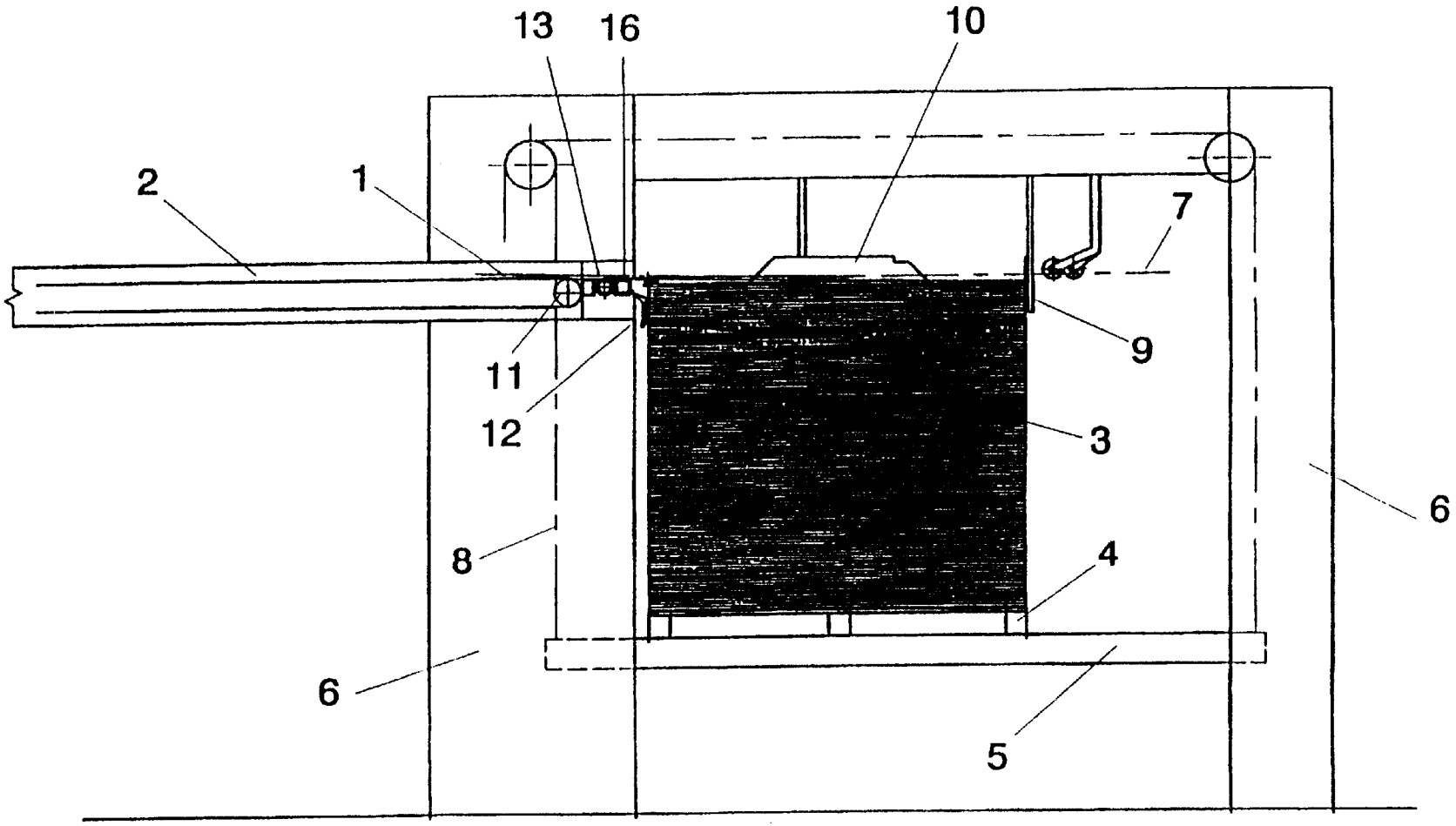
FIG. 1 is a side view of the basic construction of a stacking device according to the invention.
Figure 2:
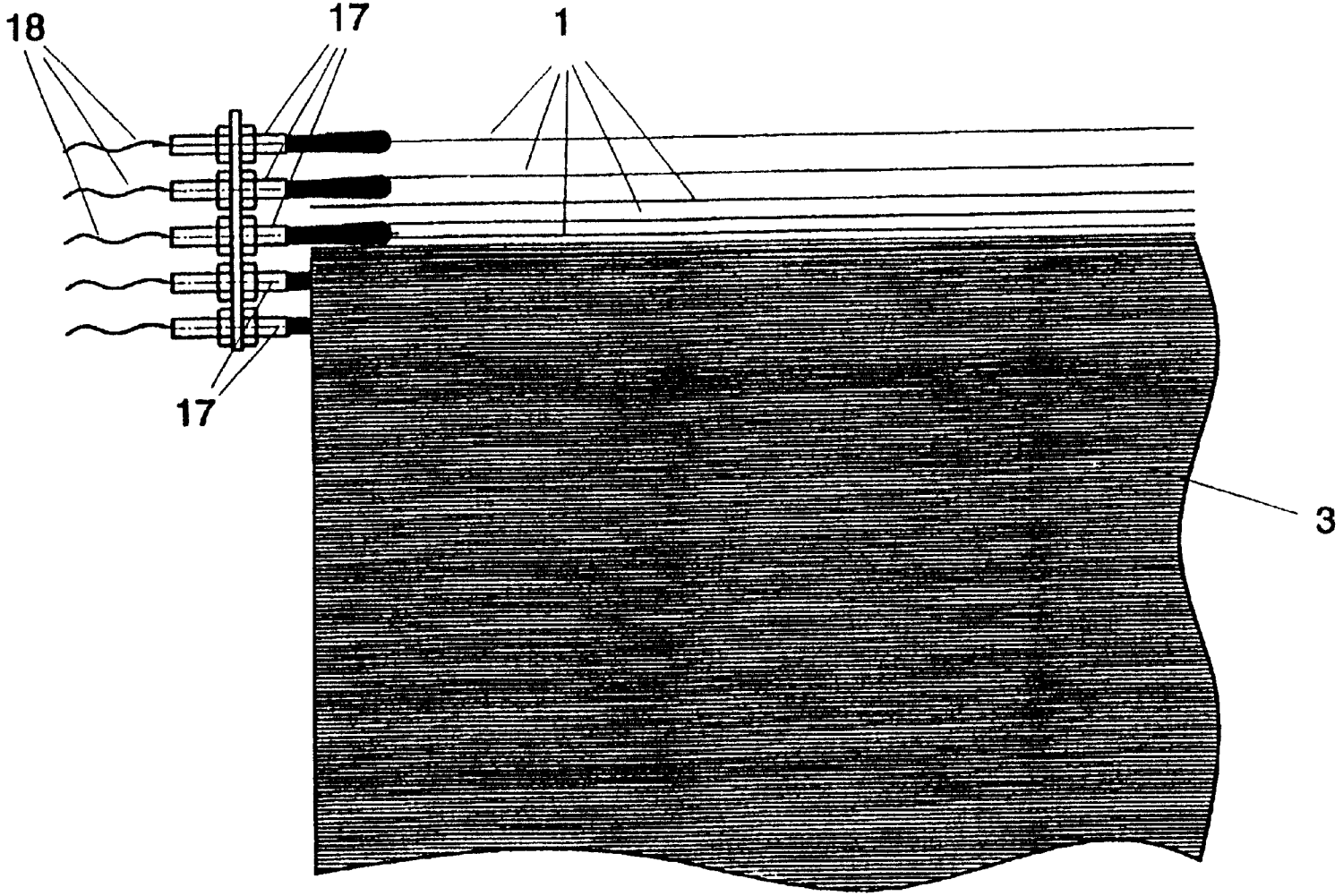
FIG. 2 is an enlarged side view of the arrangement of the optical sensors in relation to the stack.

The subsequently described embodiment serves for stacking of paper sheets 1 continuously fed in a scale-like manner arranged downstream of a crosscutter. The sheets are fed to the stacking area by a feeding conveyor 2 designed as a belt conveyor, which is arranged above the ground at a height exceeding the maximal stacking level. The stacks 3 are formed on pallets 4, which are laid upon a storage platform 5. The storage platform 5 is suspended in the frame 6 by traction chains 8. By means of the traction chains 8 the platform can be raised from floor level up to the area of the feeding level 7 of the sheets 1 and can be lowered. Furthermore the stacking device comprises the known elements for insuring that the sheets 1 are deposited on the stack 3 with correctly aligned edges: A stop plate 9 for the advancing or leading sheet edge and lateral vibrating plates 10 which act on the longitudinal sheet edges.

Between the end of the belt conveyor 2 marked by the runoff side of the guide roller 11 and the stacking area, at the height of the feeding level, the so-called discharge section is arranged, whose elements insure a trouble-free transfer of the sheets 1 to the stack 3. The area of the discharge section is shown on a larger scale in FIG. 3. Following the belt conveyor 2 is a rigid plate 12 extending vertically downwardly from the feeding level, which defines the stacking area on its incoming or upstream side. The trailing sheet edges are aligned on the plate 12. At the height of the feeding level 7, the plate 12 has recesses wherein the discharge rollers 13 are supported, which together with the blowing air nozzles 14 insure a safe transport of the sheets 1 into the stacking area. Between the discharge rollers 13 there are further recesses 15, one of which serves for lodging the device for detecting the stack level, which will be subsequently described in greater detail.

The device for detecting the stack level consists of a box-like housing 16, in whose frontal side facing the stacking area at least 3 optical sensors, five optical sensors in the example shown, are arranged vertically one above the other. Preferably reflecting optical sensors are used for the optical sensors 17, wherein light senders and light receivers are located in a housing (housing 15). The vertical distance between two sensors 17 is a maximum of 20 mm, preferably between 5 mm and 10 mm, in the present example 7.5 mm. The uppermost sensor 17 is located at a slight distance below the feeding level, whereby the distance is sufficiently big to allow for the upwards motion of the platform 5 to stop in time, so that the stack upper side remains below the feeding level. Therefore the vertical position of the uppermost sensor 17 is selected so that the stack upper side can be controlled so that it does not fall below the desired minimal distance from the feeding level, independently of the sheet material to be stacked. In the embodiment shown example the uppermost sensor 17 is located at 10 mm below the feeding level 7.

Figure 3:
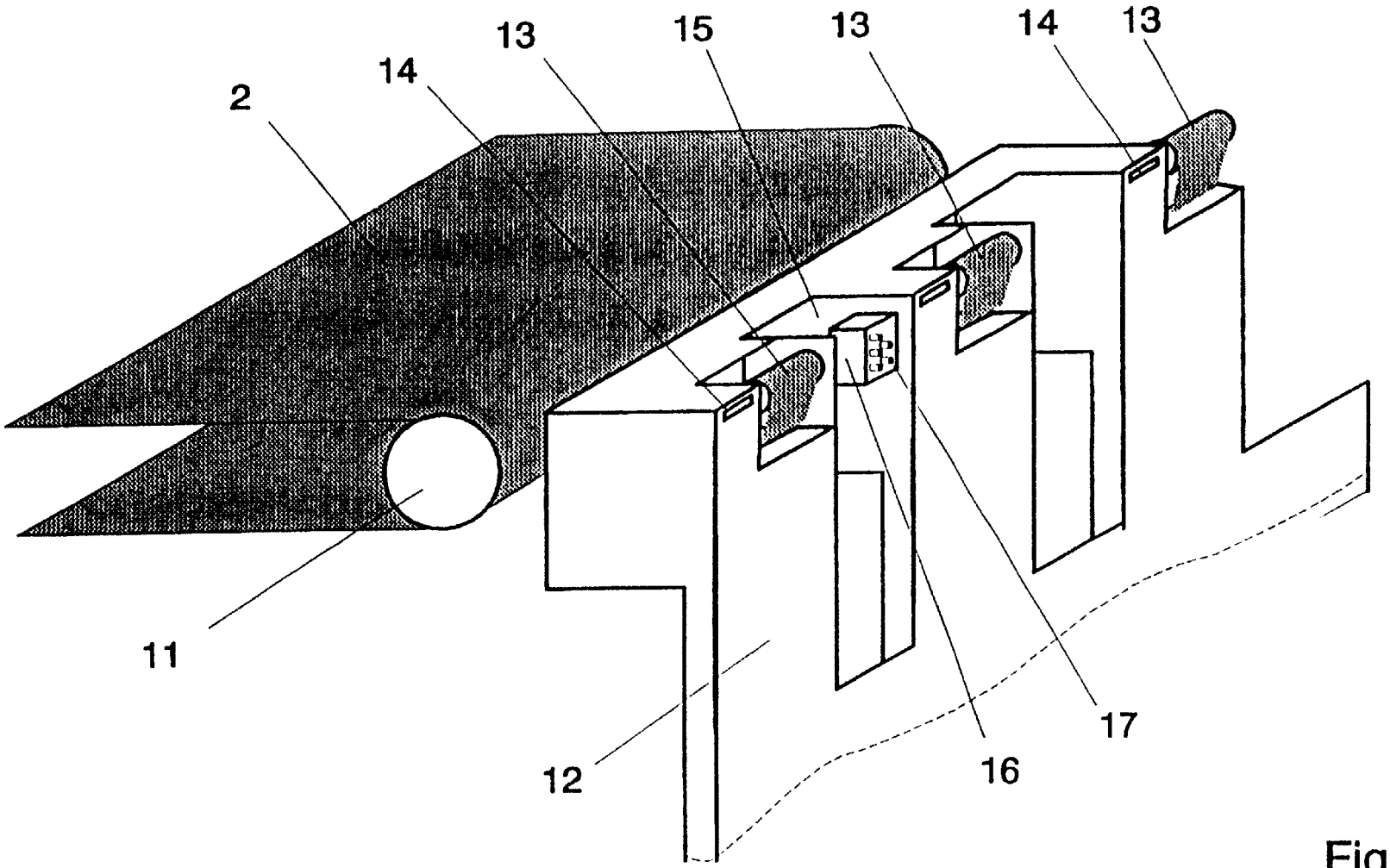
FIG. 3 is a perspective view in which shows the arrangement of the optical sensors in the discharge section in a view inclined with respect to the travel direction of the sheets.

As shown in FIG. 3, the sensors 17 are staggered in two vertical lines, in order to insure the desired slight vertical distance of two sensors 17 from each other. The signal conductors 18 are in the housing 15 and are connected to a control unit not shown in the drawing for the control of the vertical motion of the storage platform 5.

During the operation of the stacking device two of the five sensors 17 are activated, the rest remaining inactive. The uppermost of the two active sensors 17 determines the minimal distance of the stack upper side from the feeding level 7, the lower active sensor 17 determines the maximal distance. The vertical position of the stack upper side is controlled through a vertical motion of the storage platform 5, so that basically it is kept within the desired vertical range between the two active sensors 17. The control takes place suitably by means of a two point point adjustment system, which when the upper position is upwardly surpassed triggers a lowering motion of the storage platform 5, and when it falls below the lower position, triggers a lifting motion thereof.

If due to a type change of the sheets 1 to be stacked another drop height and/or another range for the acceptable drop height difference has to be set, the two corresponding sensors 17 are activated. In the simplest form with three sensors 17, the minimal drop height, as well as the adjustment range of the drop height can be set at two different values. When five sensors are used, as is the case in the embodiment example, multiple possibilities are offered to adjust the drop height by activating the two sensors 17 within a type-depending range, wherein a trouble-fee deposition of the sheets 1 is achieved. Therefore a complicated readjustment of the sensors 17 detecting the stack level in case of a type change is not required. It is merely necessary to activate the two suitable sensors 17.

We claim:

1. A device for stacking sheets on pallets, comprising:

a vertically stationary feeding conveyor for the sheets arranged above a floor at a height exceeding a maximum stacking level;

a raisable and a lowerable storage platform adapted to receive a pallet on which a stack is to be formed located at a downstream end of said conveyor; and at least three optical sensors arranged vertically one above the other at a slight distance below a feeding level at said downstream end of said conveyor and upstream of said platform at an inlet side thereof for detecting a height of the stack formed on said platform, the optical sensors being separately activatable so that selectively two of said sensors are activated for a particular sheet type while all others of said sensors are inactive, the vertical distance between two sensors being a maximum of 20 mm.

2. The device according to claim 1 wherein the vertical distance between two sensors ranges between 5 mm and 10 mm.

3. The device according to claim 1 wherein the sensors are (17) reflecting optical sensors.

* * * * *